US011455930B2

(12) United States Patent
Lee et al.

(10) Patent No.: US 11,455,930 B2
(45) Date of Patent: Sep. 27, 2022

(54) DRIVING SYSTEM FOR DRIVING A SCAN-TYPE DISPLAY

(71) Applicant: MACROBLOCK, INC., Hsinchu (TW)

(72) Inventors: Chih-Hung Lee, Hsinchu (TW); Wei-Chung Chen, Hsinchu (TW); Wei-Hsiang Cheng, Hsinchu (TW)

(73) Assignee: MACROBLOCK, INC., Hsinchu (TW)

( * ) Notice: Subject to any disclaimer, the term of this patent is extended or adjusted under 35 U.S.C. 154(b) by 0 days.

(21) Appl. No.: 17/648,441

(22) Filed: Jan. 20, 2022

(65) Prior Publication Data

US 2022/0238054 A1 Jul. 28, 2022

(30) Foreign Application Priority Data

Jan. 22, 2021 (TW) ..... 110102405

(51) Int. Cl.
*G09G 3/20* (2006.01)

(52) U.S. Cl.
CPC ..... *G09G 3/20* (2013.01); *G09G 2300/0809* (2013.01); *G09G 2310/0243* (2013.01); *G09G 2310/0267* (2013.01); *G09G 2310/08* (2013.01)

(58) Field of Classification Search
CPC ..... G09G 3/20; G09G 2300/0809; G09G 2310/0243; G09G 2310/0267; G09G 2310/08
See application file for complete search history.

(56) References Cited

U.S. PATENT DOCUMENTS

2019/0272785 A1* 9/2019 Qian ..... G09G 3/3225
2019/0272795 A1* 9/2019 Xu ..... G09G 3/36

* cited by examiner

*Primary Examiner* — Sejoon Ahn
(74) *Attorney, Agent, or Firm* — Akerman LLP; Peter A. Chiabotti

(57) ABSTRACT

A driving system includes a scan driving device. The scan driving device includes a configuration register, a counter, multiple comparators and a driver. The configuration register generates a counting parameter and multiple scan order parameters based on a serial input signal and a clock signal. The counter generates a counting value based on the clock signal, an enable signal and the counting parameter. Each comparator compares the counting value with a respective one of the scan order parameters to generate a comparison result. The driver generates multiple scan driving signals for driving a scan-type display based on the clock signal, on the enable signal and on the comparison results respectively generated by the comparators.

14 Claims, 8 Drawing Sheets

DRIVING SYSTEM FOR DRIVING A SCAN-TYPE DISPLAY

CROSS-REFERENCE TO RELATED APPLICATION

This application claims priority of Taiwanese Patent Application No. 110102405, filed on Jan. 22, 2021.

FIELD

The disclosure relates to a driving system, and more particularly to a driving system for driving a scan-type display.

BACKGROUND

A conventional driving system for driving a scan-type display to show images includes a controller, a scan driving device and a data driving device. The scan driving device is controlled by the controller to generate multiple scan driving signals that are respectively provided to multiple scan lines of the scan-type display, and the data driving device is controlled by the controller to generate multiple data driving signals that are respectively provided to multiple data lines of the scan-type display, so as to drive the scan-type display to emit light.

The conventional driving system generates the scan driving signals in such a way that the scan-type display emits light in a progressive line scan manner (i.e., consecutive lines of the line scan are adjacent to each other). As such, it may be visually perceived by a person that the image shown by the scan-type display exhibits alternating bright strips and dark strips, (i.e., the image flickers), which degrades display quality of the scan-type display. The flickering phenomenon is more noticeable when the image is a dark image.

Referring to FIG. 1, in an implementation of the conventional driving system, the scan driving device 100 is a decoder (e.g., a three to eight decoder) having multiple (e.g., three) input pins that are coupled to the controller 101 respectively via multiple (e.g., three) conductive lines. As a total number of the scan lines of the scan-type display increases, a total number of the scan driving device 100 has to increase as well, so that a total number of the scan driving signals provided by the conventional driving system can be equal to the total number of the scan lines of the scan-type display. In addition, the conductive lines, each coupled between the controller 101 and a corresponding one of the scan driving devices 100, need to have as closely the same length as possible, so that the scan driving devices 100 have as closely the same signal delay as possible with respect to the controller 101. Therefore, the conductive lines have to be compactly arranged on a printed circuit board carrying the conventional driving system, making layout of the conductive lines complex and difficult.

SUMMARY

Therefore, an object of the disclosure is to provide a driving system that can alleviate at least one drawback of the prior art.

According to the disclosure, the driving system is operatively associated with a scan-type display, and includes a scan driving device. The scan driving device is for generating a plurality of scan driving signals to drive the scan-type display, and includes a configuration register, a counter, a plurality of comparators and a driver. The configuration register is to receive a serial input signal and a clock signal, and generates a counting parameter and a plurality of scan order parameters based on the serial input signal and the clock signal. The scan order parameters respectively correspond to the scan driving signals. The counter is to receive the clock signal and an enable signal, is coupled to the configuration register to receive the counting parameter, and generates a counting value based on the clock signal, the enable signal and the counting parameter. Each of the comparators corresponds to a respective one of the scan driving signals, is coupled to the configuration register to receive one of the scan order parameters that corresponds to the respective one of the scan driving signals, is further coupled to the counter to receive the counting value, and compares the counting value with said one of the scan order parameters to generate a comparison result that corresponds to the respective one of the scan driving signals and that indicates whether the counting value is equal to said one of the scan order parameters. The driver is to receive the clock signal and the enable signal, is coupled to the comparators to receive the comparison results respectively generated by the comparators, is adapted to be further coupled to the scan-type display, and generates the scan driving signals for receipt by the scan-type display based on the clock signal, the enable signal and the comparison results. When the enable signal is at a predetermined logic level, for each of the scan driving signals, the driver changes the scan driving signal at a pace defined by the clock signal and according to the comparison result that corresponds to the scan driving signal, so as to drive the scan-type display to emit light in a manner that is dependent on the counting parameter and the scan order parameters.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
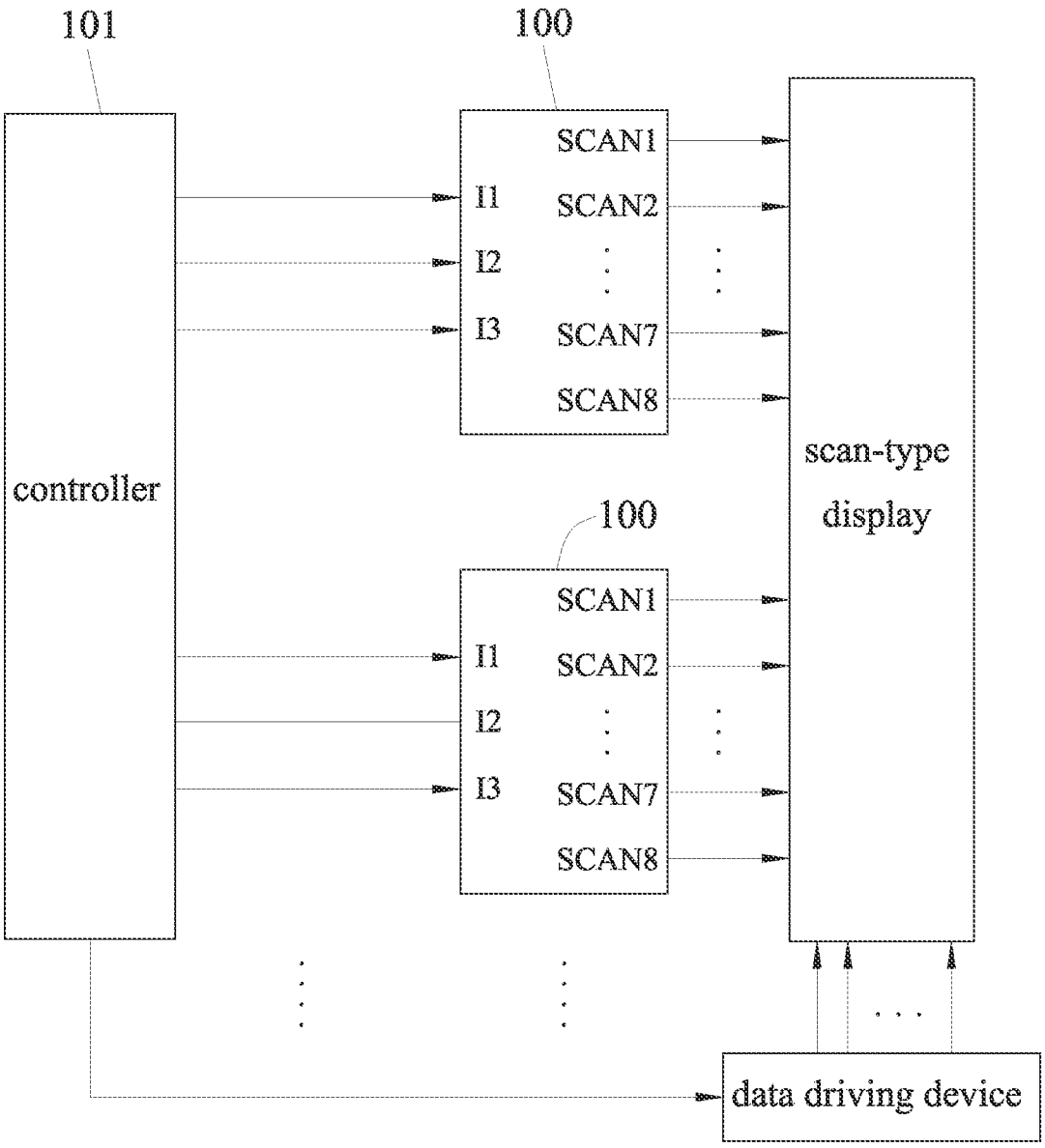
FIG.1 PRIOR ART
FIG. 1 is a block diagram illustrating an implementation of a conventional driving system for driving a scan-type display.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
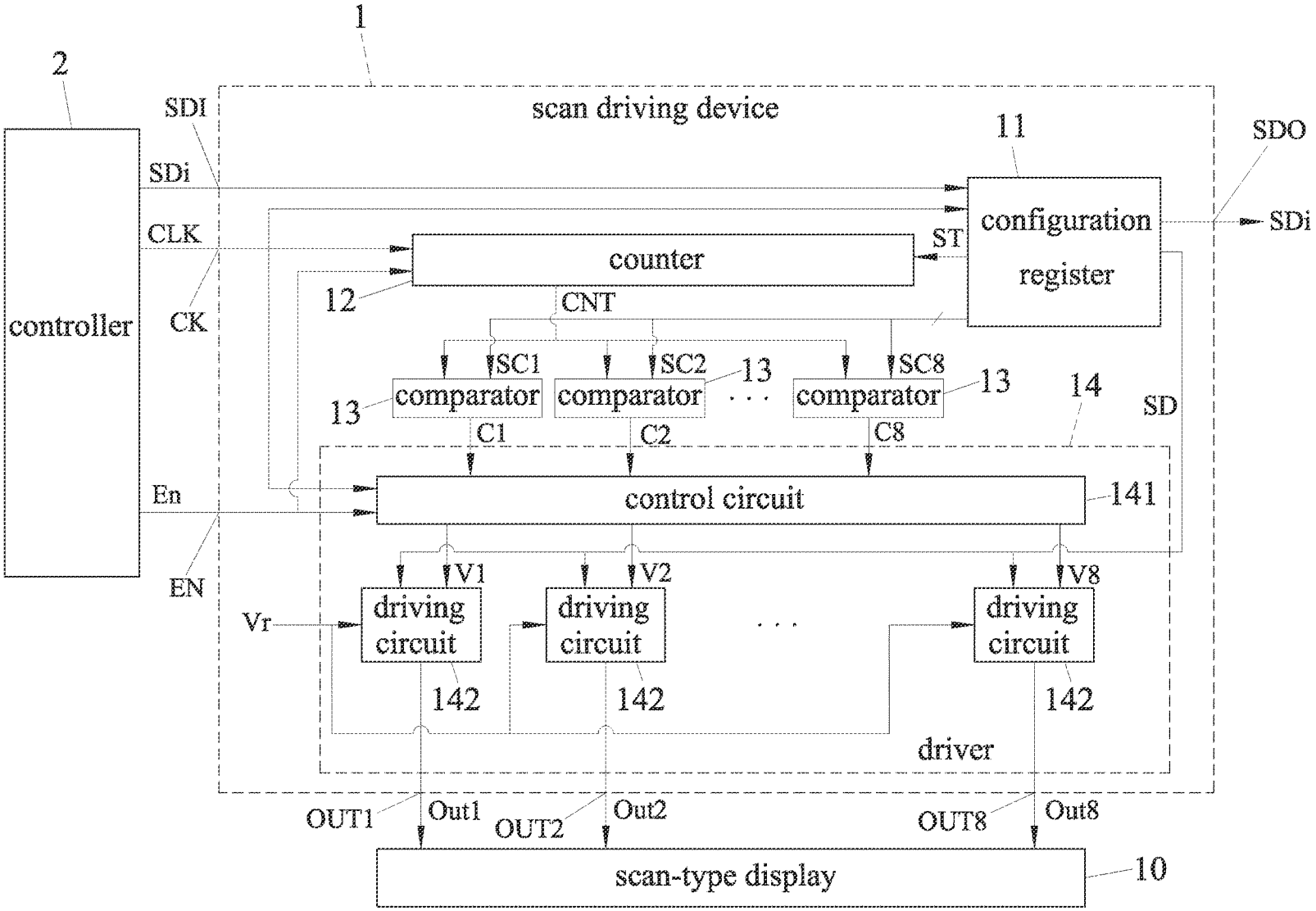
FIG. 2 is a block diagram illustrating a first embodiment of a driving system according to the disclosure for driving a scan-type display having a common anode configuration.

Referring to FIG. 2, a first embodiment of a driving system according to the disclosure is operatively associated with a scan-type display 10, and includes a scan driving device 1, a controller 2 and other elements (e.g., a data driving device) (not shown). In this embodiment, the scan-type display 10 has a common anode configuration, and includes a plurality of scan lines (e.g., eight scan lines) (not shown), a plurality of data lines (not shown), and a plurality of light emitting diodes (LEDs) (not shown) arranged in a matrix having multiple rows (e.g., eight rows) and multiple columns. Each of the rows corresponds to a respective one of the scan lines, and anodes of the LEDs in the row are coupled to the scan line that corresponds to the row. Each of the columns corresponds to a respective one of the data lines, and cathodes of the LEDs in the column are coupled to the data line that corresponds to the column. The scan driving device 1 is for generating a plurality of scan driving signals (e.g., eight scan driving signals (Out1-Out8)) that are respectively provided to the scan lines of the scan-type display 10, and the data driving device is for generating a plurality of data driving signals that are respectively provided to the data lines of the scan-type display 10, so as to control light emission of the LEDs of the scan-type display 10.

The controller 2 is configured to generate a serial input signal (SDi), a clock signal (CLK) and an enable signal (En).

The scan driving device 1 has a serial input pin (SDI) that is coupled to the controller 2 to receive the serial input signal (SDi), a clock pin (CK) that is coupled to the controller 2 to receive the clock signal (CLK), an enable pin (EN) that is coupled to the controller 2 to receive the enable signal (En), a serial output pin (SDO) that is to provide the serial input signal (SDi), and a plurality of scan output pins (e.g., eight scan output pins (OUT1-OUT8)) that are respectively coupled to the scan lines of the scan-type display 10 and that respectively provide the scan driving signals (Out1-Out8). For illustration purposes, in this embodiment, the LEDs in an $m^{th}$ one of the rows is adjacent to the LEDs in an $(m-1)^{th}$ one of the rows, where $2 \leq m \leq 8$; and an $n^{th}$ one of the scan output pins (OUTn) is coupled to the scan line that is coupled to the LEDs in an $n^{th}$ one of the rows, and an $n^{th}$ one of the scan driving signals (Outn) is provided at the $n^{th}$ one of the scan output pins (OUTn), where $1 \leq n \leq 8$. The scan driving device 1 includes a configuration register 11, a counter 12, a plurality of comparators 13 (e.g., eight comparators 13) and a driver 14.

The configuration register 11 is coupled to the serial input pin (SDI) and the clock pin (CK) to receive the serial input signal (SDi) and the clock signal (CLK), is further coupled to the serial output pin (SDO), and generates a counting parameter (ST), a plurality of scan order parameters (e.g., eight scan order parameters (SC1-SC8)) and an adjusting parameter (SD) based on the serial input signal (SDi) and the clock signal (CLK). The scan order parameters (SC1-SC8) respectively correspond to the scan driving signals (Out1-Out8). For illustration purposes, in this embodiment, an $n^{th}$ one of the scan order parameters (SCn) corresponds to the $n^{th}$ one of the scan driving signals (Outn), where $1 \leq n \leq 8$. In this embodiment, the configuration register 11 shifts the serial input signal (SDi) from the serial input pin (SDI) to the serial output pin (SDO) and stores the serial input signal (SDi) at a pace defined by the clock signal (CLK) (e.g., the acts of shifting and storing occur upon each rising edge of the clock signal (CLK)), and sets the counting parameter (ST), the scan order parameters (SC1-SC8) and the adjusting parameter (SD) based on the serial input signal (SDi) stored therein.

Figure 4:
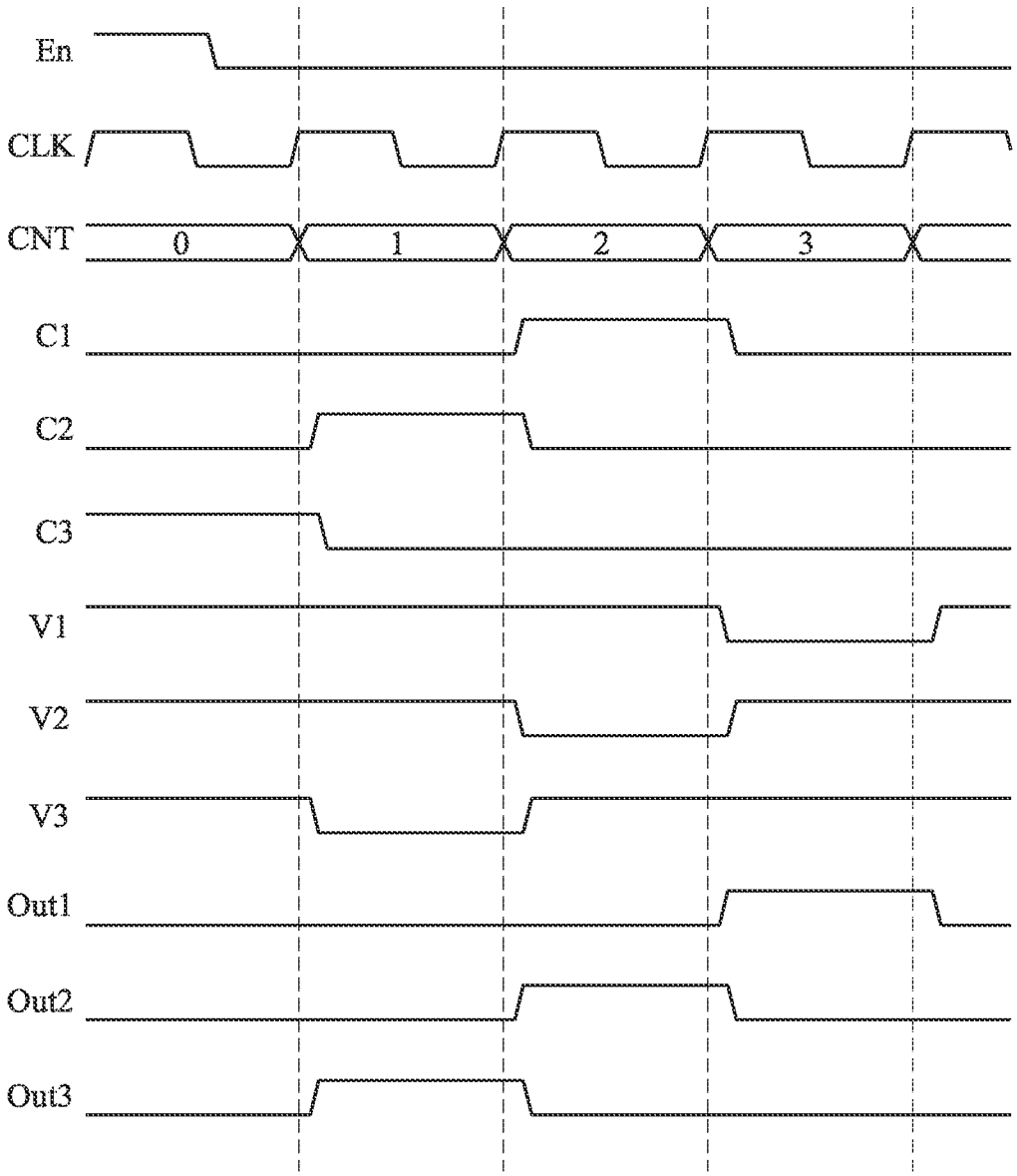
FIG. 4 is a timing diagram illustrating operations of the first embodiment.

The counter 12 is coupled to the clock pin (CK) and the enable pin (EN) to receive the clock signal (CLK) and the enable signal (En), is further coupled to the configuration register 11 to receive the counting parameter (ST), and generates a counting value (CNT) based on the clock signal (CLK), the enable signal (En) and the counting parameter (ST). In this embodiment, the enable signal (En) transitions between a first logic level and a second logic level; when the enable signal (En) is at the second logic level, the counter 12 causes the counting value (CNT) to be equal to a predetermined initial value; and when the enable signal (En) is at the first logic level, the counter 12 counts at the pace defined by the clock signal (CLK) from the predetermined initial value to a target value that is indicated by the counting parameter (ST), so as to change the counting value (CNT). A difference between the predetermined initial value and the target value is smaller than or equal to a total number of the scan lines of the scan-type display 10 (i.e., eight in this embodiment). In an example as shown in FIG. 4, the first logic level of the enable signal (En) is a logic low level; the second logic level of the enable signal (En) is a logic high level; the predetermined initial value is zero; the target value is seven; when the enable signal (En) is at the logic high level, the counter 12 causes the counting value (CNT) to be equal to zero; and when the enable signal (En) is at the logic low level, the counter 12 increments the counting value (CNT) by one upon each rising edge of the clock signal (CK) until the counting value (CNT) is equal to seven.

Each of the comparators 13 corresponds to a respective one of the scan driving signals (Out1-Out8), is coupled to the configuration register 11 to receive one of the scan order parameters (SC1-SC8) that corresponds to the respective one of the scan driving signals (Out1-Out8), is further coupled to the counter 12 to receive the counting value (CNT), and compares the counting value (CNT) with said one of the scan order parameters (SC1-SC8) to generate a comparison result (C1/C2/ . . . /C8) that corresponds to the respective one of the scan driving signals (Out1-Out8) and that indicates whether the counting value (CNT) is equal to said one of the scan order parameters (SC1-SC8). For illustration purposes, in this embodiment, the comparison result that is generated by an $n^{th}$ one of the comparators 13 (i.e., Cn, also called an $n^{th}$ one of the comparison results) corresponds to the $n^{th}$ one of the scan driving signals (Outn), where $1 \leq n \leq 8$. In the example as shown in FIG. 4, the $n^{th}$ one of the comparison results (Cn) is at a logic high level when the counting value (CNT) is equal to the $n^{th}$ one of the scan order parameters (SCn), and is at a logic low level when the counting value (CNT) is not equal to the $n^{th}$ one of the scan order parameters (SCn), where $1 \leq n \leq 8$. To be specific, the first one of the scan order parameters (SC1) is two, the second one of the scan order parameters (SC2) is one, the third one of the scan order parameters (SC3) is zero, only the first one of the comparison results (C1) is at the logic high level when the counting value is equal to two, only the second one of the comparison results (C2) is at the logic high level when the counting value is equal to one, and only the third one of the comparison results (C3) is at the logic high level when the counting value is equal to zero.

The driver 14 is coupled to the clock pin (CK) and the enable pin (EN) to receive the clock signal (CLK) and the enable signal (En), is further coupled to the configuration register 11 to receive the adjusting parameter (SD), is further coupled to the comparators 13 to receive the comparison results (C1-C8) respectively generated by the comparators 13, and is further coupled to the scan output pins (OUT1-OUT8). The driver 14 generates the scan driving signals (Out1-Out8) based on the clock signal (CLK), the enable signal (En), the adjusting parameter (SD) and the comparison results (C1-C8), and outputs the scan driving signals (Out1-Out8) respectively at the scan output pins (OUT1-OUT8). When the enable signal (En) is at the first logic level, for each of the scan driving signals (Out1-Out8), the driver 14 changes the scan driving signal (Out1/Out2/ . . . /Out8) at the pace defined by the clock signal (CLK) (so that macroscopically speaking, a rising or falling edge of the scan driving signal (Out1/Out2/ . . . /Out8) is substantially in sync with a rising or falling edge of the clock signal (CLK)) and according to the comparison result (C1/C2/ . . . /C8) that corresponds to the scan driving signal (Out1/Out2/ . . . /Out8), so as to drive the scan-type display 10 to emit light in a manner that is dependent on the counting parameter (ST) and the scan order parameters (SC1-SC8). In this embodiment, the driver 14 updates or refreshes the scan driving signal (Out1/Out2/ . . . /Out8) at the pace defined by the clock signal (CLK), causes the scan driving signal (Out1/Out2/ . . . /Out8) to be at an active logic level (i.e., a logic high level) when the comparison result (C1/C2/ . . . /C8) that corresponds to the scan driving signal (Out1/Out2/ . . . /Out8) indicates that the counting value (CNT) is equal to the scan order parameter (SC1/SC2/ . . . /SC8) that corresponds to the scan driving signal (Out1/Out2/ . . . /Out8), and causes the scan driving signal (Out1/Out2/ . . . /Out8) to be at an inactive logic level (i.e., a logic low level) when the comparison result (C1/C2/ . . . /C8) that corresponds to the scan driving signal (Out1/Out2/ . . . /Out8) indicates that the counting value (CNT) is not equal to the scan order parameter (SC1/SC2/ . . . /SC8) that corresponds to the scan driving signal (Out1/Out2/ . . . /Out8); the active logic level of the scan driving signal (Out1/Out2/ . . . /Out8) allows the LEDs driven by the scan driving signal (Out1/Out2/ . . . /Out8) to emit light; and the inactive logic level of the scan driving signal (Out1/Out2/ . . . /Out8) does not allow the LEDs driven by the scan driving signal (Out1/Out2/ . . . /Out8) to emit light, and has a voltage magnitude that is dependent on the adjusting parameter (SD), and that is smaller than a magnitude of a forward voltage of the LEDs of the scan-type display 10. When the enable signal (En) is at the second logic level, the driver 14 causes the scan driving signals (Out1-Out8) to be at the inactive logic level, so as to drive the scan-type display 10 to not emit light. In the example as shown in FIG. 4, when the enable signal (En) is at the low logic level, the driver 14 updates or refreshes the $n^{th}$ one of the scan driving signals (Outn) upon each rising edge of the clock signal (CLK), causes the $n^{th}$ one of the scan driving signals (Outn) to be at the high logic level when the $n^{th}$ one of the comparison results (Cn) is at the high logic level, and causes the $n^{th}$ one of the scan driving signals (Outn) to be at the low logic level when the $n^{th}$ one of the comparison results (Cn) is at the low logic level; and when the enable signal (En) is at the high logic level, the driver 14 causes the $n^{th}$ one of the scan driving signals (Outn) to be at the low logic level, where $1 \le n \le 8$.

In this embodiment, the driver 14 includes a control circuit 141 and a plurality of driving circuits 142 (e.g., eight driving circuits 142).

The control circuit 141 is coupled to the clock pin (CK) and the enable pin (EN) to receive the clock signal (CLK) and the enable signal (En), is further coupled to the comparators 13 to receive the comparison results (C1-C8), and generates a plurality of control signals (e.g., eight control signals (V1-V8)) based on the clock signal (CLK), the enable signal (En) and the comparison results (C1-C8). The control signals (V1-V8) respectively correspond to the scan driving signals (Out1-Out8). For illustration purposes, in this embodiment, an $n^{th}$ one of the control signals (Vn) corresponds to the $n^{th}$ one of the scan driving signals (Outn), where $1 \le n \le 8$. When the enable signal (En) is at the first logic level, for each of the control signals (V1-V8), the control circuit 141 changes the control signal (V1/V2/ . . . /V8) at the pace defined by the clock signal (CLK) and according to the comparison result (C1/C2/ . . . /C8) that corresponds to one of the scan driving signals (Out1-Out8) to which the control signal (V1/V2/ . . . /V8) corresponds. In this embodiment, the control circuit 141 updates the control signal (V1/V2/ . . . /V8) at the pace defined by the clock signal (CLK), causes the control signal (V1/V2/ . . . /V8) to be at an active logic level when the corresponding comparison result (C1/C2/ . . . /C8) indicates that the counting value (CNT) is equal to the scan order parameter (SC1/SC2/ . . . /SC8) that corresponds to the scan driving signal (Out1/Out2/ . . . /Out8) to which the control signal (V1/V2/ . . . /V8) corresponds, and causes the control signal (V1/V2/ . . . /V8) to be at an inactive logic level when the corresponding comparison result (C1/C2/ . . . /C8) indicates that the counting value (CNT) is not equal to the corresponding scan order parameter (SC1/SC2/ . . . /SC8). When the enable signal (En) is at the second logic level, the control circuit 141 causes the control signals (V1-V8) to be at the inactive logic level. In the example as shown in FIG. 4, the active logic level of the $n^{th}$ one of the control signals (Vn) is a logic low level; the inactive logic level of the $n^{th}$ one of the control signals (Vn) is a logic high level; when the enable signal (En) is at the logic low level, the control circuit 141 updates the $n^{th}$ one of the control signals (Vn) upon each rising edge of the clock signal (CLK), causes the $n^{th}$ one of the control signals (Vn) to be at the logic low level when the $n^{th}$ one of the comparison results (Cn) is at the logic high level, and causes the $n^{th}$ one of the control signals (Vn) to be at the logic high level when the $n^{th}$ one of the comparison results (Cn) is at the logic low level; and when the enable signal (En) is at the logic high level, the control circuit 141 causes the $n^{th}$ one of the control signals (Vn) to be at the logic high level, where $1 \le n \le 8$.

Each of the driving circuits 142 corresponds to a respective one of the scan driving signals (Out1-Out8), is to receive an input voltage (Vr), is coupled to the configuration register 11 to receive the adjusting parameter (SD), is further coupled to the control circuit 141 to receive one of the control signals (V1-V8) that corresponds to the respective one of the scan driving signals (Out1-Out8), and is further coupled to one of the scan output pins (OUT1-OUT8) that corresponds to the respective one of the scan driving signals (Out1-Out8). Each of the driving circuits 142 generates the respective one of the scan driving signals (Out1-Out8) based on the input voltage (Vr), the adjusting parameter (SD) and said one of the control signals (V1-V8), and outputs the respective one of the scan driving signals (Out1-Out8) at said one of the scan output pins (OUT1-OUT8).

Figure 3:
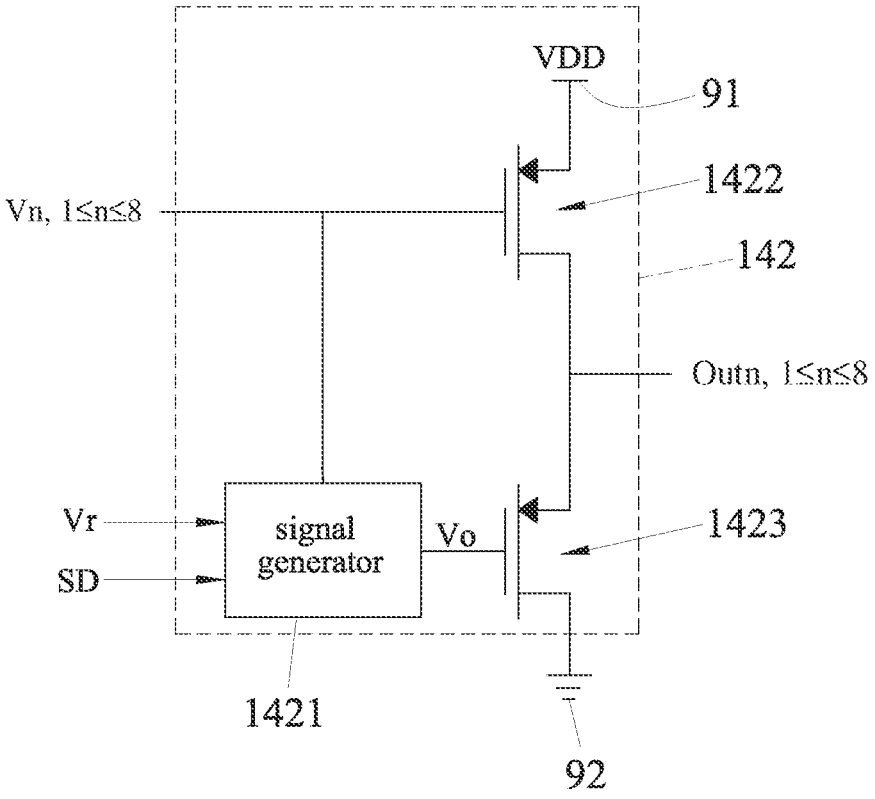
FIG. 3 is a circuit block diagram illustrating a driving circuit of the first embodiment.

Referring to FIGS. 2 and 3, in this embodiment, each of the driving circuits 142 includes a signal generator 1421, a first transistor 1422 and a second transistor 1423. The signal generator 1421 is to receive the input voltage (Vr), is coupled to the configuration register 11 to receive the adjusting parameter (SD), is further coupled to the control circuit 141 to receive said one of the control signals (V1-V8), and generates a drive signal (Vo) based on the input voltage (Vr), the adjusting parameter (SD) and said one of the control signals (V1-V8). The drive signal (Vo) is at an inactive logic level when said one of the control signals (V1-V8) is at the active logic level, and is at an active logic level when said one of the control signals (V1-V8) is at the inactive logic level. Deviation of a voltage magnitude of the active logic level of the drive signal (Vo) from a magnitude of the input voltage (Vr) is dependent on the adjusting parameter (SD). The first transistor 1422 has a first terminal that is adapted to be coupled to a first power node 91, a second terminal that is adapted to be coupled to said one of the scan output pins (OUT1-OUT8), and a control terminal that is coupled to the control circuit 141 to receive said one of the control signals (V1-V8). The first transistor 1422 conducts when said one of the control signals (V1-V8) is at the active logic level, and does not conduct when said one of the control signals (V1-V8) is at the inactive logic level. The second transistor 1423 has a first terminal that is coupled to the second terminal of the first transistor 1422, a second terminal that is adapted to be coupled to a second power node 92, and a control terminal that is coupled to the signal generator 1421 to receive the drive signal (Vo). The second transistor 1423 conducts when the drive signal (Vo) is at the active logic level, and does not conduct when the drive signal (Vo) is at the inactive logic level. The respective one of the scan driving signals (Out1-Out8) is provided at a common node of the first and second transistors 1422, 1423. In this embodiment, each of the first and second transistors 1422, 1423 is a P-type semiconductor transistor having a source terminal, a drain terminal and a gate terminal that respectively serve as the first, second and control terminals of the transistor (1422/1423); the first transistor 1422 is to receive a supply voltage (VDD) from the first power node 91; the second transistor 1423 is to receive a ground voltage from the second power node 92; the inactive logic level of each of said one of the control signals (V1-V8) and the drive signal (Vo) is a logic high level; the active logic level of each of said one of the control signals (V1-V8) and the drive signal (Vo) is a logic low level; and the voltage generator 1421 generates a plurality of reference voltages with different magnitudes based on the input voltage (Vr), selects one of the reference voltages based on the adjusting parameter (SD) to determine the voltage magnitude of the active logic level of the drive signal (Vo).

In a scenario where the predetermined initial value is zero, where the counting parameter (ST) indicates that the target value is seven, and where the scan order parameters (SC1-SC8) are of different values and all fall within a range of from zero to seven, the driving system of this embodiment can drive the scan-type display 10 to emit light in a progressive line scan manner or a non-progressive line scan manner. In a first example where a sequence cooperatively constituted by the scan order parameters (SC1-SC8) (with the $n^{th}$ one of the scan order parameters (SCn) being an $n^{th}$ term of the sequence, where $1 \leq n \leq 8$) is an arithmetic progression, the scan-type display 10 emits light in the progressive line scan manner. When SC1=0, SC2=1, SC3=2, SC4=3, SC5=4, SC6=5, SC7=6 and SC8=7, in each line scan cycle, at first, only the LEDs in the first one of the rows emit light; next, only the LEDs in the second one of the rows emit light; then, only the LEDs in the third one of the rows emit light; and so on and so forth until only the LEDs in the eighth one of the rows emit light. When SC1=7, SC2=6, SC3=5, SC4=4, SC5=3, SC6=2, SC7=1 and SC8=0, in each line scan cycle, at first, only the LEDs in the eighth one of the rows emit light; next, only the LEDs in the seventh one of the rows emit light; then, only the LEDs in the sixth one of the rows emit light; and so on and so forth until only the LEDs in the first one of the rows emit light. In a second example where the sequence cooperatively constituted by the scan order parameters (SC1-SC8) is not an arithmetic progression, the scan-type display 10 emits light in the non-progressive line scan manner. For example, when SC1=2, SC2=1, SC3=0, SC4=3, SC5=4, SC6=6, SC7=5 and SC8=7, in each line scan cycle, at first, only the LEDs in the third one of the rows emit light; next, only the LEDs in the second one of the rows emit light; then, only the LEDs in the first one of the rows emit light; next, only the LEDs in the fourth one of the rows emit light; then, only the LEDs in the fifth one of the rows emit light; next, only the LEDs in the seventh one of the rows emit light; then, only the LEDs in the sixth one of the rows emit light; and at last, the LEDs in the eighth one of the rows emit light.

In another scenario where the predetermined initial value is zero, where the counting parameter (ST) indicates that the target value is eight, and where the scan order parameters (SC1-SC8) are of different values and all fall within a range of from one to eight, the driving system of this embodiment can also drive the scan-type display 10 to emit light in the progressive line scan manner or the non-progressive line scan manner. How the scan-type display 10 is driven to emit light in the progressive line scan manner or the non-progressive line scan manner in this scenario can be inferred from the description above, and details thereof are omitted herein for the sake of brevity.

In the scan-type display 10, with respect to each of the rows, each time the LEDs in the row are driven to switch from emitting light to not emitting light, parasitic capacitances of the scan line that is coupled to the LEDs in the row would start to release charges, and the LEDs in the row will not stop emitting light immediately (i.e., ghost phenomenon occurs) if the charges flow through the LEDs in the row. In this embodiment, by virtue of each of the driving circuits 142, upon turning the first transistor 1422 of the driving circuit 142 off to drive the corresponding LEDs to not emit light, turning the second transistor 1423 of the driving circuit 142 on to discharge the parasitic capacitances of the corresponding scan line, the ghost phenomenon can be eliminated.

In addition, LEDs of different types have different forward voltages. In this embodiment, by virtue of each of the driving circuits 142 adjusting the voltage magnitude of the inactive logic level of the corresponding scan driving signal (Out1/Out2/ . . . /Out8) based on the adjusting parameter (SD), the adjusting parameter (SD) can be properly set to cause the voltage magnitude of the inactive logic level of the scan driving signals (Out1-Out8) to be smaller than the magnitude of the forward voltage of the LEDs of the scan-type display 10. Therefore, the driving system of this embodiment can be used to drive various scan-type displays with different types of LEDs.

Moreover, in this embodiment, by virtue of each of the comparators 13 comparing the counting value (CNT) with the corresponding scan order parameters (SC1/SC2/ . . . /SC8) to generate the corresponding comparison result (C1/C2/ . . . /C8), and by virtue of the driver 14 changing the scan driving signals (Out1-Out8) respectively according to the comparison results (C1-C8), the scan order parameters (SC1-SC8) can be properly set such that the scan-type display emits light in the non-progressive line scan manner, thereby eliminating flickering phenomenon of the scan-type display 10.

Figure 5:
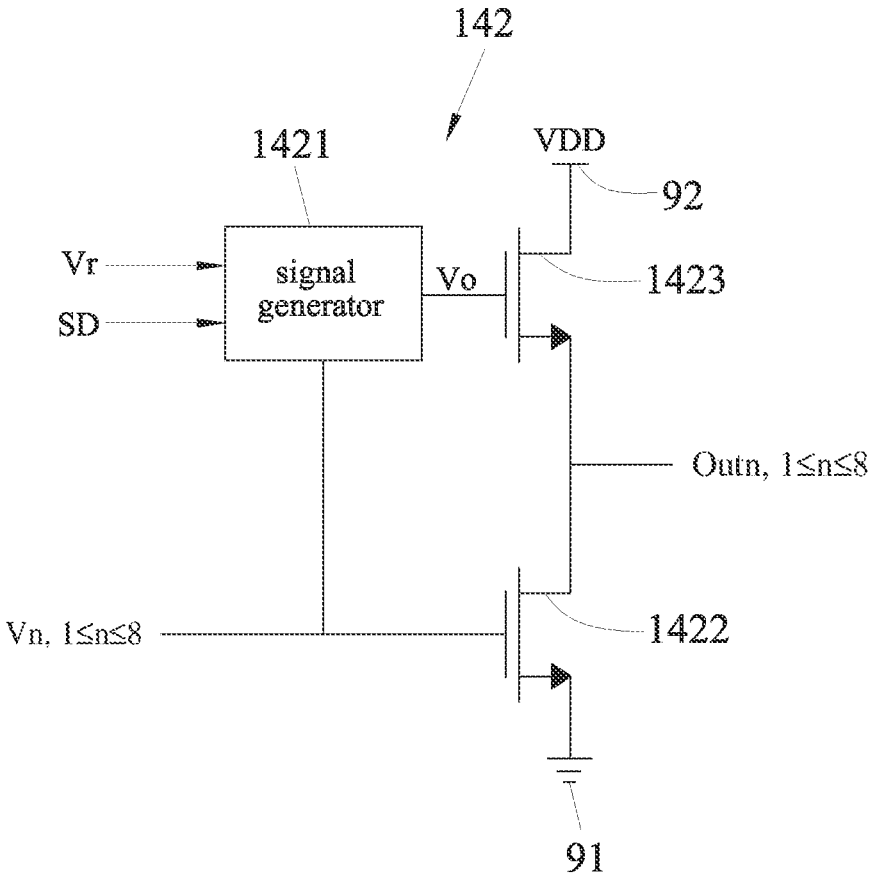
FIG. 5 is a circuit block diagram illustrating a driving circuit of a second embodiment of the driving system according to the disclosure for driving a scan-type display having a common cathode configuration.

Referring to FIGS. 2 and 5, a second embodiment of the driving system according to the disclosure is similar to the first embodiment, but differs from the first embodiment in what are described below.

In the second embodiment, the scan type display 10 has a common cathode configuration. In the scan-type display 10, each of the rows corresponds to a respective one of the scan lines, and cathodes of the LEDs in the row are coupled to the scan line that corresponds to the row; and each of the columns corresponds to a respective one of the data lines, and anodes of the LEDs in the column are coupled to the data line that corresponds to the column.

Figure 6:
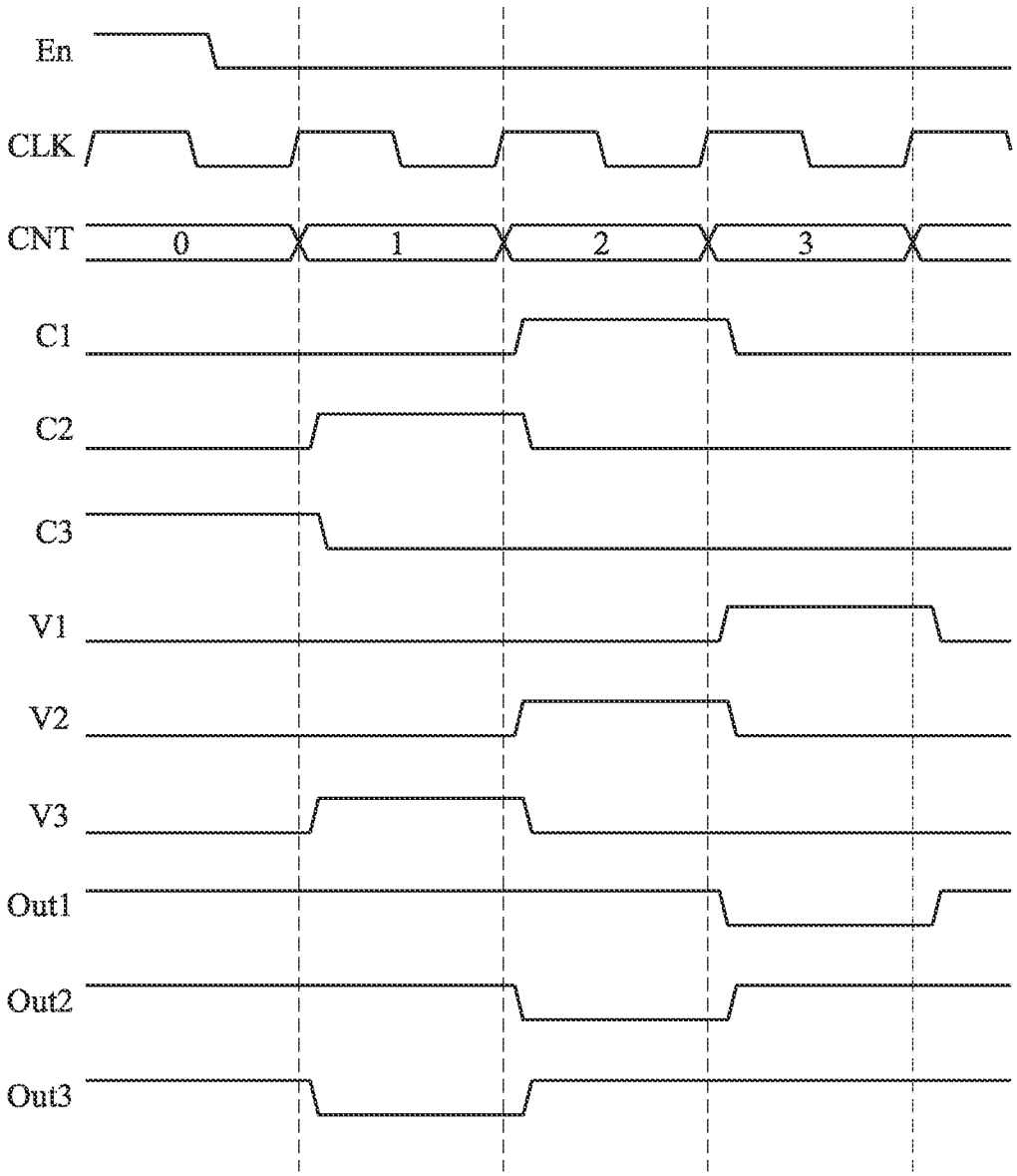
FIG. 6 is a timing diagram illustrating operations of the second embodiment.

In this embodiment, for each of the driving circuits 142, each of the first and second transistors 1422, 1423 is an N-type semiconductor transistor having a source terminal, a drain terminal and a gate terminal that respectively serve as the first, second and control terminals of the transistor 1422/1423; the first transistor 1422 is to receive the ground voltage from the first power node 91; the second transistor 1423 is to receive the supply voltage (VDD) from the second power node 92; the active logic level of the corresponding control signal (V1/V2/ . . . /V8) is a logic high level as shown in FIG. 6; the inactive logic level of the corresponding control signal (V1/V2/ . . . /V8) is a logic low level as shown in FIG. 6; the active logic level of the drive signal (Vo) is a logic high level; the inactive logic level of the drive signal (Vo) is a logic low level; the active logic level of the corresponding scan driving signal (Out1/Out2/ . . . /Out8) is a logic low level as shown in FIG. 6; and the inactive logic level of the corresponding scan driving signal (Out1/Out2/ . . . /Out8) is a logic high level as shown in FIG. 6, and has a voltage magnitude that is greater than a magnitude of the supply voltage (VDD) subtracted by a magnitude the forward voltage of the LEDs of the scan-type display 10.

In the scan-type display 10, with respect to each of the rows, each time the LEDs in the row are driven to switch from emitting light to not emitting light, parasitic capacitances of the scan line that is coupled to the LEDs in the row would start to draw charges, and the LEDs in the row will not stop emitting light immediately (i.e., ghost phenomenon occurs) if the charges flow through the LEDs in the row. In this embodiment, by virtue of each of the driving circuits 142, upon turning the first transistor 1422 of the driving circuit 142 off to drive the corresponding LEDs to not emit light, turning the second transistor 1423 of the driving circuit 142 on to charge the parasitic capacitances of the corresponding scan line, the ghost phenomenon can be eliminated.

In addition, LEDs of different types have different forward voltages. In this embodiment, by virtue of each of the driving circuits 142 adjusting the voltage magnitude of the inactive logic level of the corresponding scan driving signal (Out1/Out2/ . . . /Out8) based on the adjusting parameter (SD), the adjusting parameter (SD) can be properly set to cause the voltage magnitude of the inactive logic level of the scan driving signals (Out1-Out8) to be greater than the magnitude of the supply voltage (VDD) subtracted by the magnitude of the forward voltage of the LEDs of the scan-type display 10. Therefore, the driving system of this embodiment can be used to drive various scan-type displays with different types of LEDs.

Figure 7:
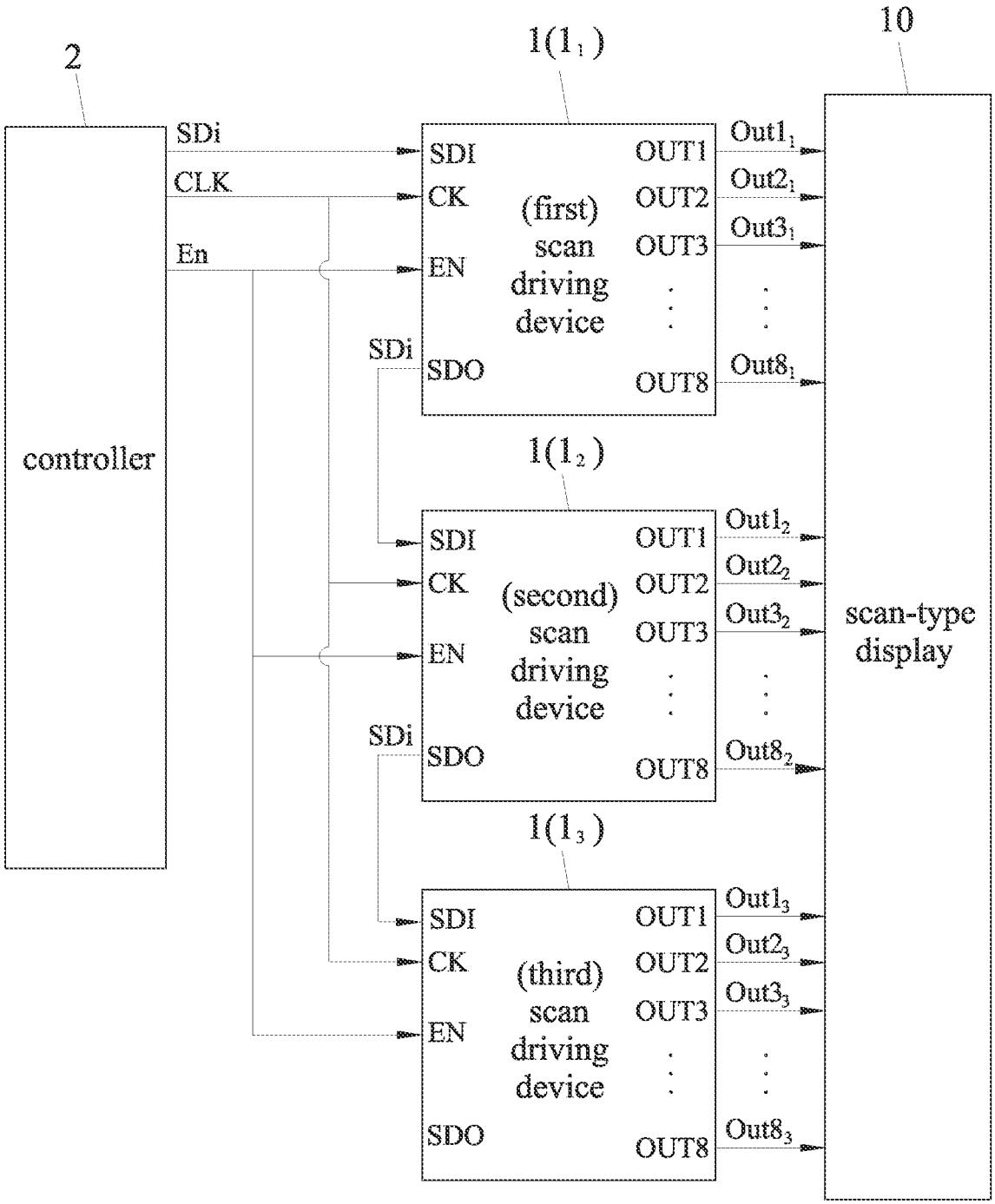
FIG. 7 is a block diagram illustrating a third embodiment of the driving system according to the disclosure for driving a scan-type display having a common anode configuration.

Referring to FIGS. 2 and 7, a third embodiment of the driving system according to the disclosure is similar to the first embodiment, but differs from the first embodiment in what are described below.

In the third embodiment, the scan-type display 10 includes twenty-four scan lines, the LEDs of the scan-type display 10 are arranged in twenty-four rows, and the driving system includes three scan driving devices 1 that are respectively a first scan driving devices $\mathbf{1}_1$, a second scan driving devices $\mathbf{1}_2$ and a third scan driving devices $\mathbf{1}_3$.

In this embodiment, the serial input pin (SDI) of the first scan driving devices $\mathbf{1}_1$ is coupled to the controller 2 to receive the serial input signal (SDi); the serial input pin (SDI) of the second scan driving devices $\mathbf{1}_2$ is coupled to the serial output pin (SDO) of the first scan driving devices $\mathbf{1}_1$ to receive the serial input signal (SDi); the serial input pin (SDI) of the third scan driving devices $\mathbf{1}_3$ is coupled to the serial output pin (SDO) of the second scan driving devices $\mathbf{1}_2$ to receive the serial input signal (SDi); the clock pins (CK) of the first to third scan driving devices $\mathbf{1}_1$-$\mathbf{1}_3$ are coupled to the controller 2 to receive the clock signal (CLK); the enable pins (EN) of the first to third scan driving devices $\mathbf{1}_1$-$\mathbf{1}_3$ are coupled to the controller 2 to receive the enable signal (En); the scan output pins (OUT1-OUT8) of the first to third scan driving devices $\mathbf{1}_1$-$\mathbf{1}_3$ are respectively coupled to the scan lines of the scan-type display 10; the first scan driving device $\mathbf{1}_1$ generates and provides the scan driving signals (Out$\mathbf{1}_1$-Out$\mathbf{8}_1$) respectively at the scan output pins (OUT1-OUT8) thereof; the second scan driving device $\mathbf{1}_2$ generates and provides the scan driving signals (Out$\mathbf{1}_2$-Out$\mathbf{8}_2$) respectively at the scan output pins (OUT1-OUT8) thereof; and the third scan driving device $\mathbf{1}_3$ generates and provides the scan driving signals (Out$\mathbf{1}_3$-Out$\mathbf{8}_3$) respectively at the scan output pins (OUT1-OUT8) thereof. For illustration purposes, in this embodiment, the LEDs in an $m^{th}$ one of the rows is adjacent to the LEDs in an $(m-1)^{th}$ one of the rows, where $2 \le m \le 4$; and an $n^{th}$ one of the scan output pins (OUTn) of the first scan driving device $\mathbf{1}_1$ is coupled to the scan line that is coupled to the LEDs in an $n^{th}$ one of the rows, an $n^{th}$ one of the scan driving signals ($Outn_1$) of the first scan driving device $\mathbf{1}_1$ is provided at the $n^{th}$ one of the scan output pins (OUTn) of the first scan driving device $\mathbf{1}_1$, an $n^{th}$ one of the scan output pins (OUTn) of the second scan driving device $\mathbf{1}_2$ is coupled to the scan line that is coupled to the LEDs in an $(n+8)^{th}$ one of the rows, an $n^{th}$ one of the scan driving signals ($Outn_2$) of the second scan driving device $\mathbf{1}_2$ is provided at the $n^{th}$ one of the scan output pins (OUTn) of the second scan driving device $\mathbf{1}_2$, an $n^{th}$ one of the scan output pins (OUTn) of the third scan driving device $\mathbf{1}_3$ is coupled to the scan line that is coupled to the LEDs in an $(n+16)^{th}$ one of the rows, and an $n^{th}$ one of the scan driving signals ($Outn_3$) of the third scan driving device $\mathbf{1}_3$ is provided at the $n^{th}$ one of the scan output pins (OUTn) of the third scan driving device $\mathbf{1}_3$, where $1 \le n \le 8$.

Figure 8:
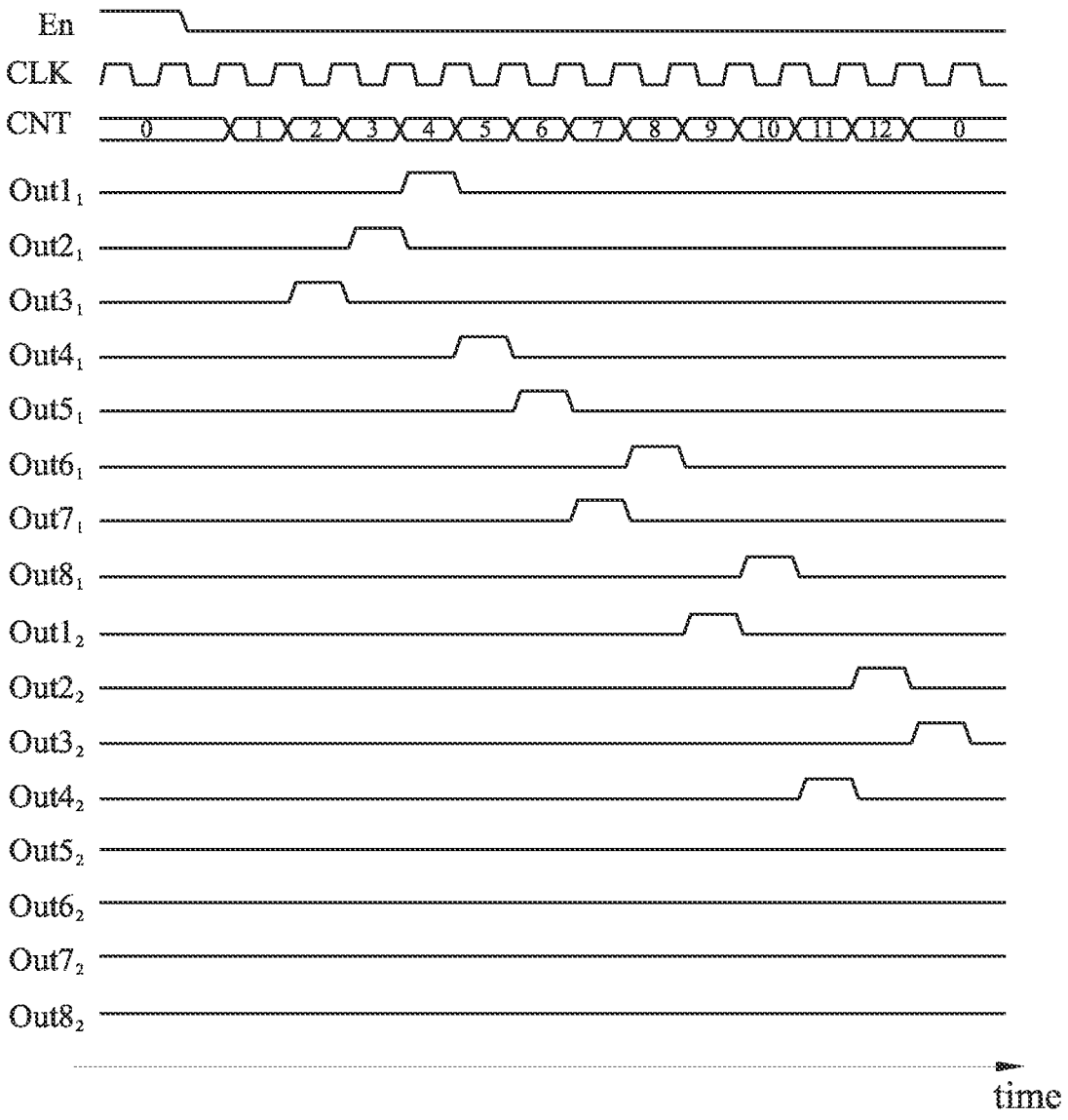
FIG. 8 is a timing diagram illustrating operations of the third embodiment.

In this embodiment, the driving system may drive the scan-type display 10 to emit light in a progressive line scan manner or a non-progressive line scan manner. FIG. 8 illustrates an example where the driving system drives the scan-type display 10 to emit light in the non-progressive line scan manner. In the example, the predetermined initial value of each of the first to third scan driving devices $\mathbf{1}_1$-$\mathbf{1}_3$ is zero, the counting parameter (ST) of each of the first to third scan driving devices $\mathbf{1}_1$-$\mathbf{1}_3$ indicates that the target value is twelve, and the scan order parameters (SC1-SC8) of the first scan driving device $\mathbf{1}_1$ and the first to fourth ones of the scan order parameters (SC1-SC4) of the second scan driving device $\mathbf{1}_2$ are of different values and fall within a range of from one to twelve. For the first scan driving device $\mathbf{1}_1$, SC1=3, SC2=2, SC3=1, SC4=4, SC5=5, SC6=7, SC7=6 and SC8=9. For the second scan driving device $\mathbf{1}_2$, SC1=8, SC2=11, SC3=12 and SC4=10. As a consequence, the LEDs in the first to twelve ones of the rows of the scan-type display 10 would emit light, and the LEDs in the thirteenth to twenty-fourth ones of the rows of the scan-type display 10 would not emit light. In each line scan cycle, at first, only the LEDs in the third one of the rows emit light; next, only the LEDs in the second one of the rows emit light; then, only the LEDs in the first one of the rows emit light; next, only the LEDs in the fourth one of the rows emit light; then, only the LEDs in the fifth one of the rows emit light; next, only the LEDs in the seventh one of the rows emit light; then, only the LEDs in the sixth one of the rows emit light; next, only the LEDs in the ninth one of the rows emit light; then, only the LEDs in the eighth one of the rows emit light; next, only the LEDs in the twelfth one of the rows emit light; then, only the LEDs in the tenth one of the rows emit light; and at last, only the LEDs in the eleventh one of the rows emit light.

In this embodiment, by virtue of the configuration register 11 of each of the first and second scan driving devices $\mathbf{1}_1$, $\mathbf{1}_2$ outputting the serial input signal (SDi) at the serial output pin (SDO) thereof, the first to third scan driving devices $\mathbf{1}_1$-$\mathbf{1}_3$ can be cascaded, so the serial input signal (SDI) is transmitted sequentially through the first to third scan driving devices $\mathbf{1}_1$-$\mathbf{1}_3$, making it simple and easy to layout conductive lines that are used to couple the controller 2 and the first to third scan driving devices $\mathbf{1}_1$-$\mathbf{1}_3$.

In view of the above, in each of the first to third embodiments, by virtue of the configuration register 11 of each scan driving device 1 generating the scan order parameters (SC1-SC8) based on the serial input signal (SDi), the scan order parameters (SC1-SC8) of the scan driving device(s) 1 can be properly set such that the driving system drives the scan-type display 10 to emit light in the non-progressive line scan manner, thereby eliminating flickering phenomenon of the scan-type display 10, and thus enhancing display quality of the scan-type display 10. In the third embodiment, by virtue of the configuration register 11 of each of the first and second scan driving devices $\mathbf{1}_1$, $\mathbf{1}_2$ outputting the serial input signal (SDi) at the serial output pin (SDO) thereof, the first to third scan driving devices $\mathbf{1}_1$-$\mathbf{1}_3$ can be cascaded so that the serial input signal (SDI) is transmitted sequentially through the first to third scan driving devices $\mathbf{1}_1$-$\mathbf{1}_3$, making it simple and easy to layout conductive lines that are used to couple the controller 2 and the first to third scan driving devices $\mathbf{1}_1$-$\mathbf{1}_3$.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

What is claimed is:

1. A driving system operatively associated with a scan-type display, and comprising:

a first scan driving device for generating a plurality of scan driving signals to drive the scan-type display, and including a configuration register to receive a serial input signal and a clock signal, and generating a counting parameter and a plurality of scan order parameters based on the serial input signal and the clock signal, the scan order parameters respectively corresponding to the scan driving signals, a counter to receive the clock signal and an enable signal, coupled to said configuration register to receive the counting parameter, and generating a counting value based on the clock signal, the enable signal and the counting parameter, a plurality of comparators, each of which corresponds to a respective one of the scan driving signals, is coupled to said configuration register to receive one of the scan order parameters that corresponds to the respective one of the scan driving signals, is further coupled to said counter to receive the counting value, and compares the counting value with said one of the scan order parameters to generate a comparison result that corresponds to the respective one of the scan driving signals and that indicates whether the counting value is equal to said one of the scan order parameters, and a driver to receive the clock signal and the enable signal, coupled to said comparators to receive the comparison results respectively generated by said comparators, adapted to be further coupled to the scan-type display, and generating the scan driving signals for receipt by the scan-type display based on the clock signal, the enable signal and the comparison results, when the enable signal is at a first logic level, for each of the scan driving signals, said driver changing the scan driving signal at a pace defined by the clock signal and according to the comparison result that corresponds to the scan driving signal, so as to drive the scan-type display to emit light in a manner that is dependent on the counting parameter and the scan order parameters.

2. The driving system of claim 1, wherein said configuration register shifts and stores the serial input signal at the pace defined by the clock signal, and sets the counting parameter and the scan order parameters based on the serial input signal stored therein.

3. The driving system of claim 1, wherein:

when the enable signal is at a second logic level, said counter causes the counting value to be equal to a predetermined initial value; and when the enable signal is at the first logic level, said counter counts at the pace defined by the clock signal and from the predetermined initial value to a target value that is indicated by the counting parameter, so as to change the counting value.

4. The driving system of claim 1, further comprising:

a controller coupled to said configuration register, said counter and said driver, and generating the serial input signal for receipt by said configuration register, the clock signal for receipt by said configuration register, said counter and said driver, and the enable signal for receipt by said counter and said driver.

5. The driving system of claim 1, wherein:

said first scan driving device having a serial input pin that is to receive the serial input signal, and a serial output pin;

said configuration register is coupled to said serial input pin and said serial output pin, and shifts the serial input signal from said serial input pin to said serial output pin at the pace defined by the clock signal.

6. The driving system of claim 5, further comprising:

a second scan driving device having a serial input pin that is coupled to said serial output pin of said first scan driving device to receive the serial input signal;

said second scan driving device being adapted to be further coupled to the scan-type display, being to further receive the clock signal and the enable signal, and generating, based on the serial input signal, the clock signal and the enable signal, a plurality of scan driving signals to drive the scan-type display.

7. The driving system of claim 1, wherein:

when the enable signal is at a second logic level, said driver causes the scan driving signals to be at an inactive logic level, so as to drive the scan-type display to not emit light.

8. The driving system of claim 1, wherein said driver includes:

a control circuit to receive the clock signal and the enable signal, coupled to said comparators to receive the comparison results, and generating, based on the clock signal, the enable signal and the comparison results, a plurality of control signals that respectively correspond to the scan driving signals;

when the enable signal is at the first logic level, for each of the control signals, said control circuit changes the control signal at the pace defined by the clock signal and according to the comparison result that corresponds to one of the scan driving signals to which the control signal corresponds;

when the enable signal is at a second logic level, said control circuit causes each of the control signals to be at an inactive logic level; and a plurality of driving circuits, each of which corresponds to a respective one of the scan driving signals, is coupled to said control circuit to receive one of the control signals that corresponds to the respective one of the scan driving signals, is adapted to be coupled to the scan-type display, and generates the respective one of the scan driving signals for receipt by the scan-type display based on said one of the control signals.

9. The driving system of claim 8, wherein:

said configuration register further generates an adjusting parameter based on the serial input signal and the clock signal; and each of said driving circuits is to further receive an input voltage, is further coupled to said configuration register to receive the adjusting parameter, and generates the respective one of the scan driving signals further based on the input voltage and the adjusting parameter.

10. The driving system of claim 9, wherein each of said driving circuits includes:

a signal generator to receive the input voltage, coupled to said configuration register to receive the adjusting parameter, further coupled to said control circuit to receive said one of the control signals, and generating a drive signal based on the input voltage, the adjusting parameter and said one of the control signals;

a first transistor having a first terminal that is adapted to be coupled to a first power node, a second terminal that is adapted to be coupled to the scan-type display, and a control terminal that is coupled to said control circuit to receive said one of the control signals; and a second transistor having a first terminal that is coupled to said second terminal of said first transistor, a second terminal that is adapted to be coupled to a second power node, and a control terminal that is coupled to said signal generator to receive the drive signal;

the respective one of the scan driving signals being provided at a common node of said first and second transistors.

11. The driving system of claim 10, wherein, for each of said driving circuits:

the drive signal is at an inactive logic level that corresponds to non-conduction of said second transistor when said one of the control signals is at an active logic level that corresponds to conduction of said first transistor, and is at an active logic level that corresponds to conduction of said second transistor when said one of the control signals is at an inactive logic level that corresponds to non-conduction of said first transistor; and deviation of a voltage magnitude of the active logic level of the drive signal from a magnitude of the input voltage is dependent on the adjusting parameter.

12. The driving system of claim 11, wherein, for each of said driving circuits, said signal generator generates a plurality of reference voltages with different levels based on the input voltage, and selects one of the reference voltages based on the adjusting parameter to determine the voltage magnitude of the active logic level of the drive signal.

13. The driving system of claim 10, wherein, for each of said driving circuits, each of said first and second transistors is a P-type semiconductor transistor, said first transistor is to receive a supply voltage from the first power node, and said second transistor is to receive a ground voltage from the second power node.

14. The driving system of claim 10, wherein, for each of said driving circuits, each of said first and second transistors is an N-type semiconductor transistor, said first transistor is to receive a ground voltage from the first power node, and said second transistor is to receive a supply voltage from the second power node.

* * * * *